US009248550B2

(12) United States Patent
Meerveld et al.

(10) Patent No.: US 9,248,550 B2
(45) Date of Patent: Feb. 2, 2016

(54) ABRASIVE WHEELS AND METHODS FOR MAKING AND USING SAME

(71) Applicants: Taeke Meerveld, Winterswijk (NL); Alessandro R. Milani, Arese (IT); Marko W Versteegen, Hengelo (NL); Grzegorz Wojciechowski, Poznan (PL); Karolina Rozanska-Zaworska, Posada (PL)

(72) Inventors: Taeke Meerveld, Winterswijk (NL); Alessandro R. Milani, Arese (IT); Marko W Versteegen, Hengelo (NL); Grzegorz Wojciechowski, Poznan (PL); Karolina Rozanska-Zaworska, Posada (PL)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 364 days.

(21) Appl. No.: 13/782,810

(22) Filed: Mar. 1, 2013

(65) Prior Publication Data

US 2013/0244542 A1 Sep. 19, 2013

Related U.S. Application Data

(60) Provisional application No. 61/606,259, filed on Mar. 2, 2012.

(51) Int. Cl.

| | |
|---|---|
| ***B24D 3/28*** | (2006.01) |
| ***B24B 23/02*** | (2006.01) |
| ***B24B 1/00*** | (2006.01) |
| ***B24D 5/04*** | (2006.01) |
| ***B24D 7/04*** | (2006.01) |

(52) U.S. Cl.
CPC ... *B24D 3/28* (2013.01); *B24B 1/00* (2013.01); *B24B 23/02* (2013.01); *B24D 5/04* (2013.01); *B24D 7/04* (2013.01)

(58) Field of Classification Search
CPC ..... B24B 23/02; B24D 3/00; B24D 3/22; B24D 3/24; B24D 3/26; B24D 3/28; B24D 3/30; B24D 3/32; B24D 7/02; B24D 7/04; B24D 7/08; B24D 5/04
See application file for complete search history.

(56) References Cited

U.S. PATENT DOCUMENTS 5,092,082 A 3/1992 Padberg et al.
5,928,394 A 7/1999 Stoetzel et al.

(Continued)

FOREIGN PATENT DOCUMENTS

WO 2004022285 A1 3/2004

OTHER PUBLICATIONS

International Search Report from PCT/US12/28680 mailed Jun. 12, 2013, 1 page.

*Primary Examiner* — Timothy V Eley
(74) *Attorney, Agent, or Firm* — Abel Law Group, LLP; Joseph P. Sullivan

(57) ABSTRACT

Abrasive articles including a body having a first abrasive layer, a second abrasive layer and one or more reinforcing layers for use with cordless tools have a reduced thickness with respect to conventional counterparts. Techniques for producing and using such abrasive articles are described. In one embodiment, the first abrasive layer and the second abrasive layer comprise abrasive particles in a bond material. In an embodiment, a reinforcing layer is disposed between the first abrasive layer and the second abrasive layer. In a particular embodiment, the body comprises an average thickness of not greater than about 5 mm. In another particular embodiment, the abrasive particles can comprise silicon carbide.

12 Claims, 4 Drawing Sheets

(56) References Cited

U.S. PATENT DOCUMENTS

| | | | | |
|---|---|---|---|---|
| 6,749,496 | B2 | 6/2004 | Mota et al. | |
| 7,351,133 | B1 * | 4/2008 | Lemberger et al. | 451/548 |
| 8,956,429 | B2 * | 2/2015 | Lee et al. | 51/298 |
| 8,961,269 | B2 * | 2/2015 | Zhang et al. | 451/56 |
| 9,017,150 | B2 * | 4/2015 | Keipert et al. | 451/534 |
| 2003/0000151 | A1 * | 1/2003 | Rosenflanz et al. | 51/309 |
| 2008/0102720 | A1 | 5/2008 | Rostal et al. | |
| 2008/0233850 | A1 * | 9/2008 | Woo et al. | 451/526 |
| 2011/0314746 | A1 * | 12/2011 | Erickson et al. | 51/309 |
| 2013/0203328 | A1 * | 8/2013 | Givot et al. | 451/548 |

* cited by examiner

ABRASIVE WHEELS AND METHODS FOR MAKING AND USING SAME

CROSS REFERENCE TO RELATED APPLICATION

The present application claims priority from U.S. Provisional Application No. 61/606,259, filed Mar. 2, 2012, entitled "ABRASIVE WHEELS AND METHODS FOR MAKING AND USING SAME," naming inventors Taeke Meerveld, Alessandro R. Milani, Marko W. Versteegen, Grzegorz Wojciechowski and Karolina Rozanska-Zaworska, which application is incorporated by reference herein its entirety.

BACKGROUND

Typically, bonded abrasive articles are prepared by blending abrasive particles with a bond and optional additives and shaping the resulting mixture, using, for instance, a suitable mold. The mixture can be shaped to form a green body which is thermally processed, for example, by curing, sintering and so forth, to produce an article in which the abrasive particles are held in a three dimensional bond matrix. Among bonded abrasive tools, abrasive (or grinding) wheels often are prepared utilizing an organic, e.g., a resin, bond. Such wheels can be reinforced using, for example, discs cut out of nylon, carbon, glass or cotton cloth, or can be un- or non-reinforced. In some cases, a workpiece needs to be processed using a battery-powered (i.e., cordless) handheld tool, however, such processes are often undesirable as they are limited by the power of the tool and life of the battery.

SUMMARY

The disclosure generally relates to bonded abrasive articles and in particular to bonded abrasive articles suitable for use for cutting and grinding with cordless tools, to methods for producing and to methods for using them.

In one aspect, the disclosure is directed to an abrasive article comprising a body including a first abrasive layer and a second abrasive layer. The first abrasive layer and the second abrasive layer comprise abrasive particles contained in a bond material. The body also comprises a reinforcing layer disposed between the first abrasive layer and the second abrasive layer. In an embodiment, the reinforcing layer may be a first reinforcing layer of a plurality of reinforcing layers. In addition, the body comprises an average thickness of not greater than about 5 mm.

In another aspect, the disclosure is directed to an abrasive article comprising a body configured to be used with a cordless handheld tool. The body includes a first abrasive layer that comprises abrasive particles contained in a bond material. In addition, the body comprises an average thickness of not greater than about 5 mm. In an embodiment, the abrasive particles can comprise silicon carbide. The body can also include a reinforcing layer overlying the first abrasive layer.

In another aspect, the disclosure is directed to a tool comprising a cordless handheld device and an abrasive article configured to be coupled to the cordless handheld device. The abrasive article can comprise a body including a first abrasive layer that comprises abrasive particles contained in a bond material. Additionally, the body can comprise a reinforcing layer overlying the first abrasive layer. Further, the body can comprise an average thickness of not greater than about 5 mm.

In another aspect, the disclosure is directed to a method of using a cordless handheld abrasive tool comprising moving an abrasive article relative to a workpiece to remove material from the workpiece. The abrasive article can comprise a body including a thin wheel shape. The body can also be configured to conduct a material removal operation for a duration of at least about 10 minutes for continuous use at a power of at least about 250 W and not greater than about 1500 W.

In another aspect, the disclosure is directed to a method of forming an abrasive article comprising disposing material for a first abrasive layer, a second abrasive layer, and one or more reinforcing layers into a mold. The method also includes heating the material for a suitable time and curing the material. After the curing operation, the thickness of the abrasive article is not greater than 5 mm.

The above and other features described herein including various details of construction and combinations of parts, and other advantages, will now be more particularly described with reference to the accompanying drawings and pointed out in the claims. It will be understood that the particular method and article embody certain features that are shown by way of illustration and not as limitations and that the principles and features described herein may be employed in various and numerous embodiments.

BRIEF DESCRIPTION OF THE DRAWINGS

In the accompanying drawings, reference characters refer to the same parts throughout the different views. The drawings are not necessarily to scale; emphasis has instead been placed upon illustrating features of the articles described herein. Of the drawings.

DETAILED DESCRIPTION

Figure 1:
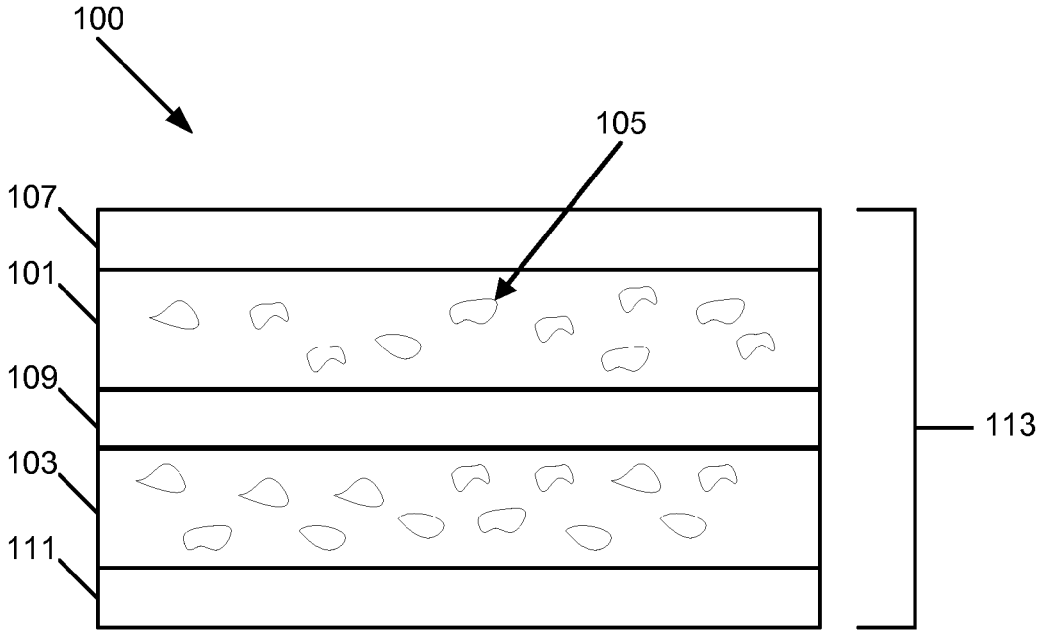
FIG. 1 is a cross-sectional view of a portion of a particular embodiment of an abrasive article.

The disclosure generally relates to bonded abrasive articles, and in particular, to bonded abrasive articles suitable for use for cutting and grinding with cordless tools, to methods for producing, and to methods for using the same. The abrasive article can be formed by making a mixture including abrasive particles, a bonding material, and other optional components, such as, for example, fillers, processing aids, lubricants, curing agents, crosslinking agents, antistatic agents, and the like. For example, the abrasive article can be formed by disposing layers of the mixture including abrasive particles, bond material and, optionally, other components above and below one or more reinforcement layers in a mold.

The mold can be made of stainless-steel, high carbon-steel, high chrome-steel, and a combination thereof. In an embodiment, the abrasive article can be formed after applying one or more heating processes to the layers of material comprising the abrasive article.

In a particular embodiment, the mixture can be used to form one or more abrasive layers in the finally-formed abrasive article. For example, the mixture can be made to form a first layer of an abrasive article. The first layer can be placed in the mold as the initial layer, or alternatively may overlie another layer, such as a reinforcing layer, within the mold.

In particular reference to components of the mixture, in an embodiment, the abrasive particles can include a material selected from the group consisting of oxides, carbides, nitrides, borides, oxynitrides, oxycarbides, oxyborides, and a combination thereof. For example, the abrasive particles can comprise alumina. In another example, the abrasive particles can comprise silicon carbide. In at least one embodiment, the abrasive particles can consist essentially of silicon carbide.

In an embodiment, the abrasive particles can comprise an average particle size of not greater than about 900 microns, not greater than about 850 microns, not greater than about 800 microns, not greater than about 780 microns, or even not greater than about 750 microns. In another embodiment, the abrasive particles can comprise an average particle size of at least about 1 micron, at least about 50 microns, at least about 100 microns, at least about 150 microns, at least about 200 microns, at least about 250 microns, at least about 300 microns, at least about 320 microns. It will be appreciated that the average particle size can be within a range between any of the above minimum and maximum values.

The mixture may include a blend of a first abrasive particle type and a second abrasive particle type. The blend can comprise a different content (wt %) of the first abrasive particle type than a content (wt %) of the second abrasive particle type. In an embodiment, the blend can comprise a greater content of the first abrasive particle type than a content of the second abrasive particle type. According to one embodiment, the blend can include not greater than about 90% of the first abrasive particle type. In other instances, the blend can include not greater than about 80%, not greater than about 75%, not greater than about 70%, or not greater than about 65% of the first abrasive particle type. In at least one embodiment, the blend may include at least about 20%, at least about 30%, at least about 40%, at least about 50%, or even at least about 55% of the first abrasive type. It will be appreciated that the blend can include an amount of the first abrasive particle type within a range between any of the above minimum and maximum values.

The blend can include a remainder amount of the second abrasive type. The blend may consist essentially of the first abrasive particle type and the second abrasive particle type. In certain other embodiments, the blend can include additional other abrasive particle types, including for example a third abrasive particle type.

Additionally, the blend can include a first abrasive particle type that may have a first average particle size and the second abrasive particle type that may have a second average particle size. In an embodiment, the first average particle size can be different than the second average particle size. In a particular embodiment, the first average particle size can be at least about 5% different than the second average particle size based on the equation $((Ps1-Ps2)/Ps1)\times100\%$, where Ps1 represents the first average particle size and Ps2 represents the second average particle size. In a further embodiment, the first average particle size can be at least about 10% different than the second average particle size, such as at least about 15% different than the second average particle size, at least about 20% different than the second average particle size, at least about 25% different than the second average particle size, at least about 30% different than the second average particle size, at least about 40% different than the second average particle size, at least about 45% different than the second average particle size. In certain embodiments, the first average particle size may be not greater than about 99% different than the second average particle size, such as not greater than about 95% different than the second average particle size, not greater than about 90% different than the second average particle size, not greater than about 80% different than the second average particle size, not greater than about 70% different than the second average particle size, not greater than about 60% different than the second average particle size, not greater than about 50% different than the second average particle size. It will be appreciated that the difference between the content of the first average particle size and the second average particle size can be within a range between any of the above minimum and maximum values.

Further, the first average particle size can be greater than the second average particle size. For example, the first average particle size can be at least about 20 microns greater than the second average particle size, at least about 50 microns greater than the second average particle size, at least about 80 microns greater than the second average particle size, at least about 120 microns greater than the second average particle size, at least about 160 microns greater than the second average particle size, at least about 190 microns greater than the second average particle size, at least about 230 microns greater than the second average particle size, at least about 350 microns greater than the second average particle size. In another example, the first average particle size can be not greater than about 550 microns larger than the second average particle size, not greater than about 450 microns larger than the second average particle size, not greater than about 300 microns larger than the second average particle size, not greater than about 260 microns larger than the second average particle size, not greater than about 210 microns larger than the second average particle size, not greater than about 175 microns larger than the second average particle size, not greater than about 140 microns larger than the second average particle size, not greater than about 100 microns larger than the second average particle size. It will be appreciated that the difference between the first average particle size and the second average particle size can be within a range between any of the above minimum and maximum values.

In one embodiment, the first average particle size may be not greater than about 900 microns, not greater than about 800 microns, not greater than about 700 microns, not greater than about 600 microns, not greater than about 500 microns. In yet another embodiment, the first average particle size can be at least about 200 microns, at least about 300 microns, at least about 400 microns, or even at least about 450 microns. It will be appreciated that the first average particle size can be within a range between any of the above minimum and maximum values.

Additionally, in one embodiment, the second average particle size may be not greater than about 800 microns, not greater than about 700 microns, not greater than about 600 microns, not greater than about 500 microns, not greater than about 400 microns. In another embodiment, the second average particle size can be at least about 100 microns, at least about 200 microns, at least about 300 microns, at least about 320 microns. It will be appreciated that the second average particle size can be within a range between any of the above minimum and maximum values.

In one embodiment, the mixture, which can be used to form at least the first abrasive layer, can comprise not greater than about 80 wt % abrasive particles for the total weight of the abrasive layer, not greater than about 75 wt %, not greater than about 72 wt % not greater than about 60 wt %, not greater than about 50 wt % In another embodiment, the mixture used to form at least the first abrasive layer can comprise at least about 1 wt % abrasive particles for the total weight of the abrasive layer, at least about 5 wt %, at least about 10 wt %, at least about 15 wt %, at least about 20 wt %, at least about 25 wt %, at least about 30 wt %, at least about 40 wt %, at least about 50 wt %, at least about 60 wt %, at least about 65 wt %. It will be appreciated that the content of abrasive particles in the abrasive layer can be within a range between any of the above minimum and maximum values.

The bond material can comprise material selected from the group consisting of an inorganic material, an organic material, and a combination thereof. In an embodiment, the bond material can comprise an organic material selected from the group consisting of epoxy resins, polyester resins, polyurethanes, polyester, rubber, polyimide, polybenzimidazole, aromatic polyamide, modified phenolic resins, novalic resin, resol resin, and a combination thereof. In a particular embodiment, the bond material consists essentially of a resin.

The bond material can comprise a blend of a first resin type and a second resin type. The blend can comprise a different content of the first resin type than a content of the second resin type, wherein content is measured as weight percent of the total weight of the bond material. In a particular embodiment, the blend can comprise a greater content of the first resin type than a content of the second resin type. In one embodiment, the blend can include a first resin type present in an amount of at least about 5% different than an amount of the second resin type based on the equation $((Rt1-Rt2)/Rt1)\times100\%$, where Rt1 represents the first resin type and Rt2 represents the second resin type. According to one embodiment, the blend can include no greater than about 90% of the first resin type. In other instances, the blend can include not greater than about 80% of the first resin type, not greater than about 75%, not greater than about 70%, or not greater than about 65% of the first resin type. In at least one embodiment, the blend may include at least about 20%, at least about 30%, at least about 40%, at least about 50%, or even at least about 55% of the first resin type. It will be appreciated that the blend can include an amount of the first resin type within a range between any one of the above minimum and maximum values.

The blend can include a remainder amount of the second resin type. The blend may consist essentially of the first resin type and the second resin type. In certain other embodiments, the blend can include additional other resin types including, for example, a third resin type. Further, the amount of the first resin type in the blend can be greater than the amount of the second resin type.

In an embodiment, the first resin type can be different material than the second resin type. In a particular embodiment, the first resin type can comprise a composition that is different than a composition of the second resin type. For example, the first resin type can comprise a novolac resin, and the second resin type can comprise a resol resin. In a particular example, the resol resin can be furfuryl alcohol based. In an additional example, the novolac resin can include hexamethylenetetramine. To illustrate, the novolac resin can include hexamethylenetetramine within a range of about 8 wt % to about 20 wt %. In one embodiment, the novolac type resin can have a flow distance within a range of about 20 mm to 35 mm.

In one embodiment, the mixture, which can be used to form at least the first abrasive layer, can comprise not greater than about 50 wt % bond material for the total weight of the abrasive layer, not greater than about 40 wt %, not greater than about 35 wt %, not greater than about 30 wt %, not greater than about 25 wt %, not greater than about 20 wt %, not greater than about 18 wt %. In another embodiment, the mixture can comprise at least about 1 wt % bond material for the total weight of the abrasive layer, at least about 3 wt %, at least about 6 wt %, at least about 10 wt %, at least about 12 wt %. It will be appreciated that the amount of the bond material for the total weight of the abrasive layer can be within a range between any of the above minimum and maximum values.

In an embodiment, the abrasive layer can also comprise a filler. In a particular embodiment, the bond material of the abrasive layer can include the filler. The filler can have a material selected from the group consisting of powders, granules, spheres, fibers, and a combination thereof. In one embodiment, the filler can comprise a material selected from the group consisting of an inorganic material, an organic material, and a combination thereof. In a further embodiment, the filler can include a material selected from the group consisting of sand, bubble alumina, bauxite, chromites, magnesite, dolomites, bubble mullite, borides, titanium dioxide, carbon products (e.g., carbon black, coke or graphite), wood flour, clay, talc, hexagonal boron nitride, molybdenum disulfide, feldspar, nepheline syenite, glass spheres, glass fibers, $CaF_2$, $KBF_4$, Cryolite ($Na_3AlF_6$), potassium Cryolite ($K_3AlF_6$), pyrites, ZnS, copper sulfide, mineral oil, fluorides, carbonates, calcium carbonate, and a combination thereof. Additionally, the filler can include a material selected from the group consisting of an antistatic agent, a metal oxide, a lubricant, a porosity inducer, coloring agent, and a combination thereof.

The mixture, which may be used to form at least the first abrasive layer, can comprise not greater than about 30 wt % filler for the total weight of the abrasive layer, not greater than about 25 wt %, not greater than about 22 wt %, not greater than about 20 wt %, not greater than about 18 wt %, not greater than about 16 wt %, not greater than about 14 wt %. In an embodiment, the mixture can comprise at least about 1 wt % filler for the total weight of the abrasive layer, at least about 3 wt %, at least about 6 wt %, at least about 8 wt %, at least about 10 wt %, at least about 12 wt %. It will be appreciated that the amount of the filler for the total weight of the abrasive layer can be within a range between any of the above minimum and maximum values. In one embodiment, the first abrasive layer comprises a greater content of a resin than filler.

In an embodiment, the abrasive article can be formed from one or more mixtures, such as a mixture used to form a first abrasive layer and a mixture used to form a second abrasive layer. The mixture used to form the first abrasive layer can comprise one or more materials (e.g. abrasive particle, bond material, filler, etc.) that are different from the mixture used to form the second abrasive layer. In a particular embodiment, the mixture used to form the first abrasive layer can comprise a first type of abrasive particle and the mixture used to form the second abrasive layer can comprise a second type of abrasive particle. In one embodiment, the first type of abrasive particle can be the same as the second type of abrasive particle. In another embodiment, the first type of abrasive particle can be different than the second type of abrasive particle. Additionally, the mixture used to form the first abrasive layer can comprise a first type of bond material, and the mixture used to form the second abrasive layer can comprise a second type of bond material. In one embodiment, the first type of bond material can be the same as the second type of bond material. In another embodiment, the first type of bond material can be different than the second type of bond material.

The abrasive article can also be formed by providing material for one or more reinforcing layers. The reinforcing layer can comprise a material selected from the group consisting of an organic material, an inorganic material, and a combination thereof. Additionally, the reinforcing layer can comprise a material selected from the group consisting of a fabric, a fiber, a film, a woven material, a non-woven material, a glass, a fiberglass, a ceramic, a polymer, a resin, a polymer, a fluorinated polymer, an epoxy resin, a polyester resin, a polyurethane, a polyester, a rubber, a polyimide, a polybenzimidazole, an aromatic polyamide, a modified phenolic resin, and a combination thereof.

In an illustrative embodiment, the abrasive article can be formed by placing a number of components into a mold. For example, one or more abrasive layers can be formed from one or more mixtures, as described in embodiments herein. Furthermore, one or more layers of reinforcing materials may be combined with the abrasive layers as described herein. In certain constructions, an abrasive layer can be overlying or underlying the reinforcing material. In at least one embodiment, the abrasive layer can be in direct contact with the reinforcing layer. For one embodiment, the abrasive layer can be bonded directly to and at least partially impregnating portions of the reinforcing layer. In other designs of embodiments herein, at least one reinforcing layer (or a plurality of reinforcing layers) can be disposed between a first and second abrasive layer. More particularly, the first and second abrasive layers can be in direct contact with the reinforcing layer. According to one construction, a plurality of reinforcing layers can be employed as discrete intervening layers separating at least first and second abrasive layers. It will be appreciated that any combination of reinforcing layers and abrasive layers are contemplated herein.

Materials for other components of the abrasive article can also be placed into the mold. For example, a metal ring can be placed into the mold. The metal ring can be used to couple the abrasive article to a tool. In an embodiment, materials comprising the abrasive article can be placed into the mold in a particular order to form an abrasive article having particular properties. After adding the materials of the abrasive article to the mold, the materials are pressed, stacked between curing plates, and cured.

In a particular embodiment, an abrasive article can be formed by first placing material of a first reinforcing layer in the bottom of the mold. In one embodiment, a layer of material, such as a paper sheet, can be placed between the bottom of the mold and the material for the first reinforcing layer. Additionally, material for a first abrasive layer can be disposed on top of the first reinforcing layer within the mold. Further, material for a second reinforcing layer can be disposed on top of the first abrasive layer. Material for a second abrasive layer can be disposed on top of the second reinforcing layer. Moreover, material for a third reinforcing layer can be disposed on top of the second abrasive layer. A metal ring can be disposed on top of the third reinforcing layer. In an embodiment, material can be disposed between the third reinforcing layer and the metal ring, such as a paper blotter.

After disposing layers of material in the mold for the abrasive article, the abrasive article can be formed by cold pressing, warm pressing, or hot pressing. In a particular embodiment, after pressing the materials in the mold and stacking them between curing plates, the materials are baked for a suitable period of time at a suitable temperature or range of temperatures. In one embodiment, the temperature may be not greater than about 300° C., not greater than about 260° C., not greater than about 220° C., not greater than about 185° C., not greater than about 160° C., not greater than about 135° C. In another embodiment, the temperature may be at least about 110° C., at least about 145° C., at least about 170° C., at least about 195° C. It will be appreciated that the temperature can be within a range between any of the above minimum and maximum values.

FIG. 1 is a cross-sectional view of a portion of a body of a particular embodiment of an abrasive article 100. The abrasive article 100 includes a first abrasive layer 101 and a second abrasive layer 103. The first abrasive layer 101 and the second abrasive layer 103 can include a number of abrasive particles, such as abrasive particle 105. The abrasive particles of the first abrasive layer 101 and the second abrasive layer 103 can have the features of abrasive particles described in embodiments herein. For example, the first abrasive layer 101 and the second abrasive layer 103 can comprise an average particle size of not greater than about 500 microns, and at least about 0.1 microns. Additionally, the first abrasive layer 101 and the second abrasive layer 103 can be formed to have the features of any embodiment described herein. For example, the first abrasive layer 101 and second abrasive layer 103 can have not greater than about 80 wt % abrasive particles for the total weight of each respective abrasive layer 101, 103. In another example, the first abrasive layer 101 and the second abrasive layer 103 can have at least about 1 wt % abrasive particles for the total weight of each respective abrasive layer 101, 103.

The abrasive article 100 also includes a first reinforcing layer 107, a second reinforcing layer 109, and a third reinforcing layer 111. The reinforcing layers 107, 109, 111 can be formed from one or more mixtures, as described in embodiments herein. Furthermore, materials for one or more abrasive layers can be combined with one or more reinforcing layers 107, 109, 111 as described herein. In certain constructions, one or more of the reinforcing layers can be overlying or underlying material for an abrasive layer. In at least one embodiment, a reinforcing layer can be in direct contact with an abrasive layer. In a particular embodiment, a reinforcing layer can be bonded directly to and at least partially impregnating portions of an abrasive layer. In other designs of embodiments herein, at least one abrasive layer (or a plurality of abrasive layers) can be disposed between a first reinforcing layer and a second reinforcing layer. According to one construction, a plurality of abrasive layers can be employed as discrete intervening layers separating at least first and second reinforcing layers. It will be appreciated that any combination of reinforcing layers and abrasive layers are contemplated herein.

In the illustrative embodiment of FIG. 1, a reinforcing layer overlies each of the abrasive layers 101, 103. For example, the first reinforcing layer 107 overlies the first abrasive layer 101 and the second reinforcing layer 109 overlies the second abrasive layer 103. Further, a reinforcing layer may support each of the abrasive layers 101, 103. To illustrate, the second reinforcing layer 109 can support the first abrasive layer 101 from the bottom and the third reinforcing layer 111 can support the second abrasive layer 103 from the bottom.

In particular embodiments, the body of the abrasive article 100 may be made to have particular geometric features such that it is suitable for use in particular applications, such as for use with cordless, handheld tools. In one instance, the body of the abrasive article 100 can have an average thickness 113 of not greater than about 5 mm. In an embodiment, the average thickness 113 of the body can be less, such as not greater than about 4.8 mm, not greater than about 4.6 mm, not greater than about 4.4 mm, not greater than about 4.2 mm, not greater than about 4 mm, not greater than about 3.8 mm, not greater than about 3.6 mm, not greater than about 3.4 mm, not greater than about 3.2 mm, not greater than about 3 mm, not greater than about 2.9 mm, or even not greater than about 2.7 mm. In still other embodiments, the average thickness of the body of the abrasive article 100 can be at least about 1 mm, at least about 1.2 mm, at least about 1.4 mm, at least about 1.6 mm, at least about 1.8 mm at least about 2 mm, at least about 2.2 mm, or even at least about 2.3 mm. It will be appreciated that the average thickness of the body can be within a range between any of the above minimum and maximum values.

In one embodiment, one or more of the layers 101, 103, 107, 109, 111 can have varying thicknesses relative to each other. For example, the first abrasive layer 101 can have a different thickness relative to the second abrasive layer 103. Moreover, the first abrasive layer 101 can have a different thickness with respect to any of the reinforcing layers 107, 109, and 111. Still, in certain other designs of embodiments herein, one or more of the layers 101, 103, 107, 109, 111 of the body of the abrasive article can have substantially the same thickness. For example, the first abrasive layer 101 can have substantially the same thickness relative to the second abrasive layer 103. Moreover, the first abrasive layer 101 may have substantially the same thickness with respect to any of the reinforcing layers 107, 109, and 111.

In an embodiment, the body of the abrasive article 100 can comprise a porosity of at least about 1 vol % for the total volume of the body, at least about 3 vol %, at least about 5 vol %, at least about 10 vol %. In another embodiment, the body of the abrasive article 100 can comprise a porosity of not greater than about 45 vol % for the total volume of the body, not greater than about 40 vol %, not greater than about 35 vol %. It will be appreciated that the porosity for the total volume of the body can be within a range between any of the above minimum and maximum values.

Further, first abrasive layer 101, the second abrasive layer 103, or both can comprise a porosity of at least about 1 vol % for the total volume of the respective abrasive layer, at least about 3 vol %, at least about 5 vol %, at least about 10 vol %. Additionally, the first abrasive layer 101, the second abrasive layer 103, or both can comprise a porosity of not greater than about 30 vol % for the total volume of the respective abrasive layer, not greater than about 28 vol %, or even not greater than about 25 vol %. It will be appreciated that the porosity for the total volume of the respective layer can be within a range between any of the above minimum and maximum values.

Figure 2:
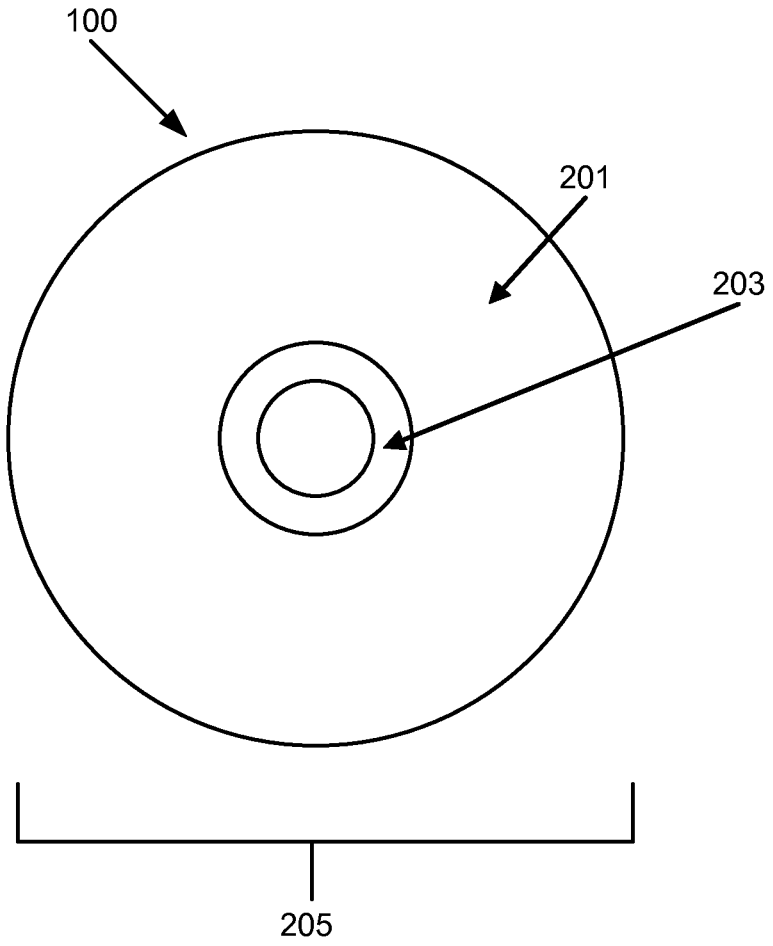
FIG. 2 is a view of an abrasive article shaped as a wheel and having a depressed center in accordance with an embodiment.

FIG. 2 includes a top view of an abrasive article 100 shaped as a wheel and having a depressed center. The abrasive article 100 can include a first member 201 and a second member 203. The first member 201 can comprise a body as described in the embodiments herein, that can include at least a first abrasive layer and one or more reinforcing layers. The second member 203 can comprise a metal ring coupled to the abrasive article 100. The second member 203 may be suitable for facilitating coupling of the abrasive article to a tool, such as a cordless handheld tool.

The abrasive article 100 can also include a diameter 205. In an embodiment, the diameter 205 can be not greater than about 200 mm, not greater than about 160 mm, not greater than about 110 mm, or even not greater than about 70 mm. In another embodiment, the diameter 205 can be at least about 40 mm, at least about 90 mm, at least about 140 mm. It will be appreciated that the diameter 205 can be within a range between any of the above minimum and maximum values.

Figure 3:
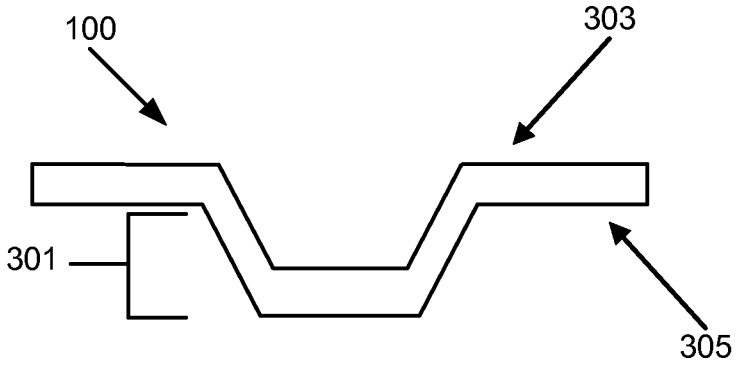
FIG. 3 is a cross-sectional view of the abrasive article of FIG. 2.

FIG. 3 includes a cross-sectional view of the abrasive article 100 of FIG. 2. In the illustrative embodiment of FIG. 3, the abrasive article 100 can comprise a reinforced depressed center flexible wheel. The abrasive article 100 can comprise a raised hub region 301. In addition, FIG. 3 shows a working face 303 of the abrasive article 100, where the working face is configured to contact a workpiece. In one embodiment, the working face 303 can comprise a pattern of features. In another embodiment, the working face 303 can be essentially free of a pattern of features. FIG. 3 also shows a non-working face 305. The non-working face 305 can comprise a patterned surface in one embodiment, and in another embodiment, the non-working face 305 can be essentially free of a pattern of features.

Figure 4:
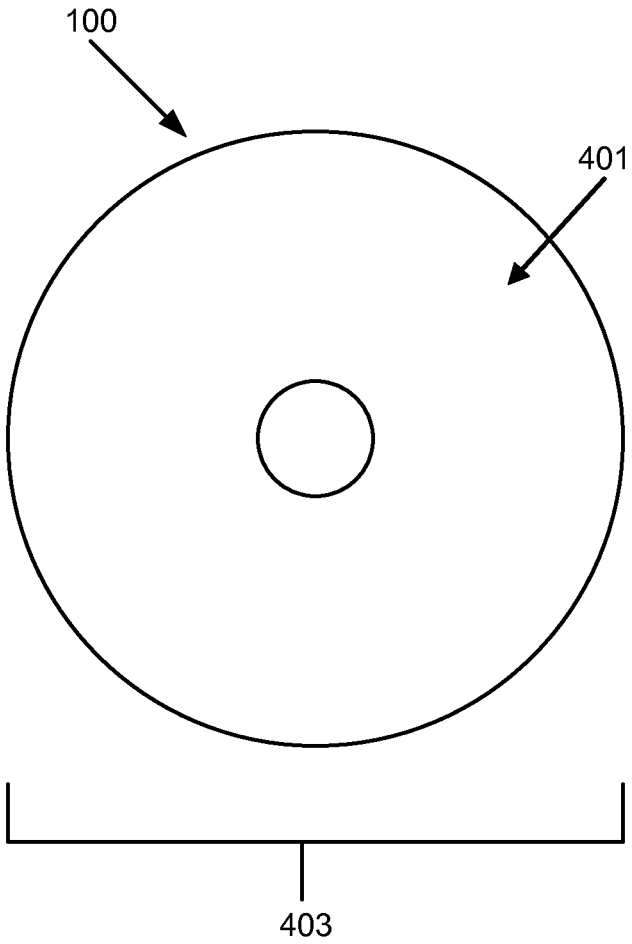
FIG. 4 is a view of an abrasive article shaped as a wheel and having a substantially planar profile in accordance with an embodiment.

FIG. 4 includes a top view of an abrasive article 100 shaped as a wheel and having a substantially planar profile. The abrasive article 100 can include a body 401 having a diameter 403. As explained in the embodiments herein, the body 401 can have at least a first abrasive layer and one or more reinforcing layers.

Figure 5:
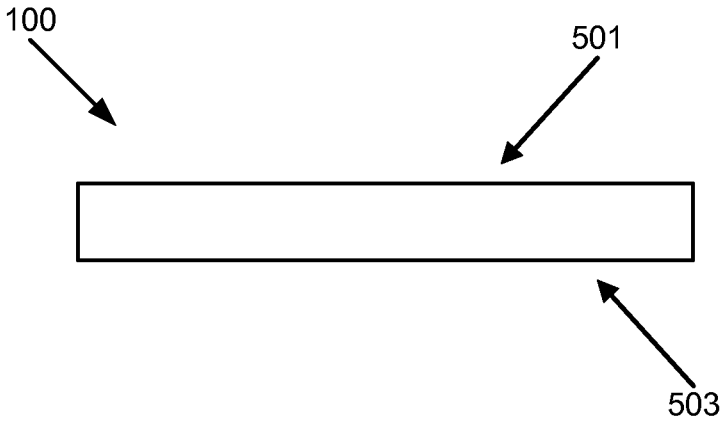
FIG. 5 is a cross-sectional view of the abrasive article of FIG. 4.

FIG. 5 includes a cross-sectional view of the abrasive article 100 of FIG. 4. In the particular illustrative embodiment, of FIG. 5, the faces 501, 503 of the abrasive article 100 are substantially planar.

Figure 6:
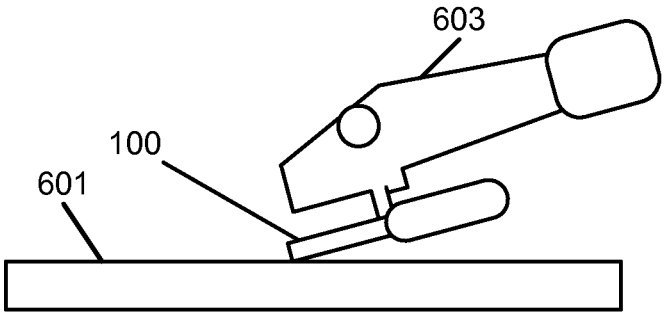
FIG. 6 is an illustration of removing material from a workpiece using a cordless tool having an abrasive article in accordance with an embodiment.

FIG. 6 includes an illustration of removing material from a workpiece 601 at a first angle using a cordless handheld tool 603 having an abrasive article 100. The cordless handheld tool 601 can have a weight not greater than 3 kg, not greater than 2.5 kg, not greater than 2.1 kg, not greater than 1.9 kg, at least 1.5 kg, at least 1.8 kg, at least 2.3 kg. In a particular embodiment, the first angle can be about 15°. The workpiece 601 can comprise a material selected from the group consisting of steel, glass, aluminum, concrete, stone, copper, polyvinylchloride, wood, stainless steel, or any combination thereof.

Figure 7:
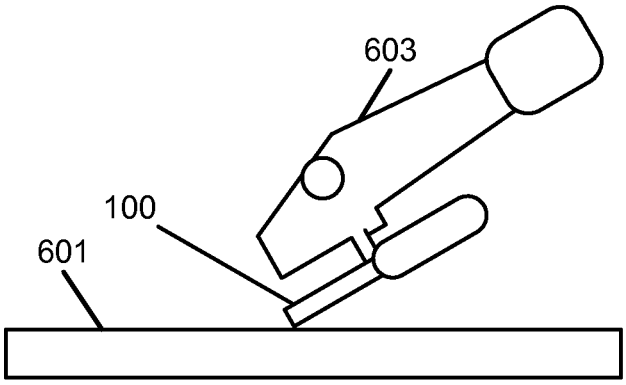
FIG. 7 is an illustration of removing material from a workpiece using a cordless tool having an abrasive article in accordance with an embodiment.

FIG. 7 includes an illustration of removing material from a workpiece 601 at a second angle using a cordless handheld tool 603 having an abrasive article 100. In a particular embodiment, the second angle can be about 30°.

Figure 8:
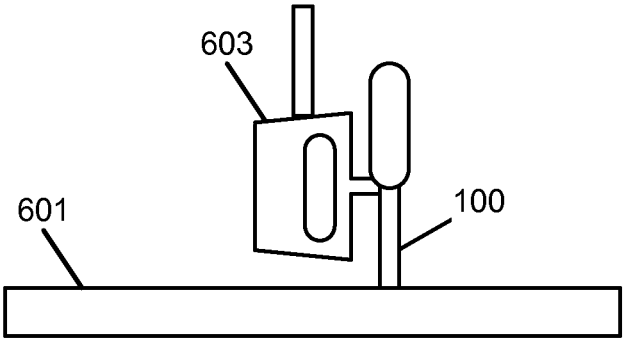
FIG. 8 is an illustration of removing material from a workpiece using a cordless tool having an abrasive article in accordance with an embodiment.

FIG. 8 includes an illustration of removing material from a workpiece 601 at a third angle using a cordless handheld tool 603 having an abrasive article 100. In a particular embodiment, the third angle can be about 90°. It will be appreciated that FIGS. 6-8 are illustrative of various manners in which the abrasive article may be utilized, and is not a limited description of the entire capabilities of the abrasive article.

In an embodiment, the abrasive article 100 can be coupled to a spindle of the cordless handheld tool 603 to conduct a material removal operation on the workpiece 601. The material removal operation can include an operation selected from the group consisting of cutting, grinding, finishing, and a combination thereof. The spindle can be coupled to a motor that is driven by a battery power source, such as a Lithium-Ion battery. The battery power source can have a voltage of not greater than about 40 V, not greater than about 35 V, not greater than about 30 V, not greater than about 25 V, not greater than 20 V. Additionally, the battery power source can have a voltage of at least about 10 V, at least about 15 V, at least about 18 V, at least about 28 V. It will be appreciated that the voltage of the battery power source can be within a range between any of the above minimum and maximum values.

In an embodiment, the cordless handheld tool 603 can operate at a power of not greater than about 1750 W, not greater than about 1500 W, not greater than about 1250 W, not greater than about 1000 W, not greater than about 850 W, or even not greater than about 650 W. In another embodiment, the cordless handheld tool 403 can operate at a power of at least about 300 W, at least about 450 W, at least about 700 W, at least about 950 W. It will be appreciated that the power of the cordless handheld tool 603 can be within a range between any of the above minimum and maximum values.

The cordless handheld tool 603 can also operate at a speed of not greater than about 11,000 rpm, not greater than about 10,000 rpm, not greater than about 9,000 rpm, not greater than about 8,000 rpm. Further, the cordless handheld tool 603 can operate at a speed of at least about 6,000 rpm, at least about 6,500 rpm, at least about 7,000 rpm, at least about 7,500 rpm. It will be appreciated that the difference between a speed of the cordless handheld tool 603 can be within a range between any of the above minimum and maximum values.

In an illustrative embodiment, an operator can use the cordless handheld tool 601 by moving the abrasive article 100 relative to the workpiece 603. In an embodiment, the abrasive article 100 can include a thin wheel shape. The cordless handheld tool 601 can be used to conduct a material removal operation for a duration of at least about 10 minutes of continuous use, at least about 12 minutes, at least about 14 minutes, at least about 15 minutes, at least about 16 minutes, at least about 18 minutes, at least about 20 minutes, at least about 22 minutes, at least about 24 minutes, at least about 26 minutes, at least about 28 minutes, or even at least about 30 minutes. In certain instances, the cordless handheld tool 601 may be utilized for a full charge of the battery electronically coupled to the cordless handheld tool 601.

Aspects described herein relate to abrasive articles for use with cordless material removal tools. These abrasive articles provide advantages over conventional abrasive articles used with cordless material removal tools. In particular, the reduced thickness of the abrasive articles and the resulting reduction in weight, leads to increased battery life for the cordless material removal tools. Specifically, cordless material removal tools draw less energy from their batteries when using the abrasive articles described herein. Thus, operators of cordless material removal tools using these abrasive articles can be more productive due to the increased length of time that the tools can be used. Additionally, the composition of the abrasive articles is suitable for application to workpieces of a variety of materials, such as steel, glass, aluminum, concrete, stone, copper, PVC, wood, stainless steel, and so forth. In contrast, conventional abrasive articles are applicable to only particular types of materials, such as stainless steel or stone, but not both. Accordingly, the abrasive articles described herein provide convenience to the operator because the operator can remove material from multiple different types of material without having to change the abrasive article coupled to the cordless tool.

The concepts described herein will be further described in the following examples, which do not limit the scope of the invention described in the claims.

EXEMPLIFICATION

In a particular example, an abrasive article is formed from a mixture of an abrasive layer having between about 68-72 wt % abrasive particles and between about 28-32 wt % bond material. The abrasive particles comprise black silicon carbide having grit sizes of 36 and 46 present in a proportion of about 60/40, respectively. The bond material comprises between approximately 12-15 wt % phenolic resins and between approximately 12-15 wt % filler materials. The phenolic resins include resol and novolac type resins present in a proportion between about 25/75 to about 50/50. The resol type resin is a furfuryl alcohol based resin. The novolac type resin includes about 12 wt % hexamethylenetetraamine with a flow distance of 25-30 mm. The filler materials include about 55 wt % potassium aluminum fluoride, about 44 wt % calcium carbonate, and less than about 3 wt % of mineral oil and carbon black.

The abrasive article is formed by placing the following components into a mold in the order presented: bottom glass cloth with black paper sheet, layer of abrasive mixture, middle glass cloth, layer of abrasive mixture, top glass cloth, paper blotter, metal ring. The components are pressed while in the mold, stacked between curing plates, and finally baked with a curing cycle having a dwell temperature of between about 170° C. and about 185° C. Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. An abrasive article comprising:

a body configured to be used with a cordless handheld tool, the body including:

a first abrasive layer comprising abrasive particles contained in a bond material, the abrasive particles comprising silicon carbide;

a second abrasive layer comprising abrasive particles contained in a bond material, the abrasive particles comprising silicon carbide;

a first reinforcing layer disposed between the first abrasive layer and the second abrasive layer; and wherein the body comprises an average thickness of not greater than about 5 mm.

2. The abrasive article of claim 1, wherein the abrasive particles of the first abrasive layer comprise an average particle size of not greater than about 500 microns, and at least about 0.1 microns.

3. The abrasive article of claim 1, wherein the first abrasive layer comprises not greater than about 80 wt % abrasive particles for the total weight of the first abrasive layer, and at least about 5 wt %.

4. The abrasive article of claim 1, wherein the bond material comprises an organic material selected from the group consisting of epoxy resins, polyester resins, polyurethanes, polyester, rubber, polyimide, polybenzimidazole, aromatic polyamide, modified phenolic resins, and a combination thereof, wherein the bond material consists essentially of a resin.

5. The abrasive article of claim 1, wherein the first abrasive layer comprises not greater than about 80 wt % bond material for the total weight of the first abrasive layer, and at least about 1 wt %.

6. The abrasive article of claim 1, wherein the body comprises a porosity of at least about 1 vol % for the total volume of the body, and not greater than about 45 vol %.

7. The abrasive article of claim 1, wherein the first abrasive layer comprises a porosity of at least about 1 vol % for the total volume of the first abrasive layer, and not greater than about 30 vol %.

8. The abrasive article of claim 1, wherein the body has a weight of not greater than 3 kg and at least 1.5 kg.

9. The abrasive article of claim 1, wherein the body is configured to be attached to a spindle of the cordless handheld tool, wherein the spindle is coupled to a motor, wherein the motor is driven by a battery power source, wherein the cordless handheld tool is configured to operate at a power of not greater than about 1750 W and at least about 300 W.

10. The abrasive article of claim 1, wherein the body is configured to conduct a material removal operation on a workpiece comprising a material selected from the group consisting of steel, glass, aluminum, concrete, stone, copper, polyvinylchloride, wood, stainless steel, or any combination thereof.

11. The abrasive article of claim 1, wherein the body is configured to conduct a material removal operation selected from the group consisting of cutting, grinding, finishing, and a combination thereof.

12. The abrasive article of claim 1, wherein the body is configured to conduct a material removal operation for a duration of at least about 10 minutes for continuous use at a power of at least about 300 W and not greater than about 1600 W for a full charge of a battery electronically coupled to the cordless handheld tool.

* * * * *